US010088210B2

(12) United States Patent
Ishikawa

(10) Patent No.: US 10,088,210 B2
(45) Date of Patent: Oct. 2, 2018

(54) REFRIGERATION CYCLE APPARATUS

(71) Applicant: Mitsubishi Electric Corporation, Tokyo (JP)

(72) Inventor: Tomotaka Ishikawa, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 35 days.

(21) Appl. No.: 15/509,971

(22) PCT Filed: Sep. 30, 2014

(86) PCT No.: PCT/JP2014/076048
§ 371 (c)(1),
(2) Date: Mar. 9, 2017

(87) PCT Pub. No.: WO2016/051493
PCT Pub. Date: Apr. 7, 2016

(65) Prior Publication Data
US 2017/0299241 A1 Oct. 19, 2017

(51) Int. Cl.
*F25B 49/02* (2006.01)
*F25B 9/00* (2006.01)

(52) U.S. Cl.
CPC ..... *F25B 49/02* (2013.01); *F25B 9/008* (2013.01); *F25B 2339/044* (2013.01); *F25B 2500/07* (2013.01)

(58) Field of Classification Search
CPC ..... F25B 43/00; F25B 2400/23; F25B 49/02; F25B 2339/044; F25B 43/006
See application file for complete search history.

(56) References Cited

U.S. PATENT DOCUMENTS 4,246,760 A * 1/1981 Cann ..... F25B 47/022 62/155
4,266,405 A * 5/1981 Trask ..... F25B 13/00 62/160

(Continued)

FOREIGN PATENT DOCUMENTS

EP 2 420 765 A1 2/2012
JP S49-128344 A 12/1974

(Continued)

OTHER PUBLICATIONS

Extended European Search Report dated May 4, 2018 issued in corresponding EP patent application No. 14903075.1.

(Continued)

*Primary Examiner* — Cassey D Baur
(74) *Attorney, Agent, or Firm* — Posz Law Group, PLC

(57) ABSTRACT

The refrigeration cycle apparatus includes: liquid-side connection piping that extends from liquid-side refrigerant piping; gas-side connection piping that extends from gas-side refrigerant piping; a refrigerant storage tank that stores refrigerant, an intake side thereof being connected to the liquid-side connection piping, and a discharge side thereof being connected to the gas-side connection piping; an inlet-side electromagnetic valve that is disposed on the liquid-side connection piping, and that is opened when there is no passage of electric current; an inlet-side check valve that is disposed on the liquid-side connection piping, and that allows the refrigerant to flow only toward the refrigerant storage tank; and a valve apparatus that is disposed on the gas-side connection piping, that is opened during passage of electric current to the inlet-side electromagnetic valve, and that is delayed before being shut off after passage of electric current to the inlet-side electromagnetic valve is stopped.

18 Claims, 4 Drawing Sheets

(56) References Cited

U.S. PATENT DOCUMENTS

| | | | | | |
|---|---|---|---|---|---|
| 4,735,059 | A * | 4/1988 | O'Neal | F25B 41/04 | 62/196.4 |
| 5,070,705 | A * | 12/1991 | Goodson | F25B 41/04 | 62/196.4 |
| 5,996,360 | A * | 12/1999 | Tanaka | B60H 1/00907 | 62/159 |
| 6,006,532 | A * | 12/1999 | Suzuki | B60H 1/3225 | 62/225 |
| 9,410,727 | B1 * | 8/2016 | Boyko | F25B 47/006 | |
| 2002/0095944 | A1 * | 7/2002 | Stensrud | F25B 41/04 | 62/352 |
| 2004/0250568 | A1 * | 12/2004 | Sienel | F25B 9/008 | 62/513 |

FOREIGN PATENT DOCUMENTS

| | | | |
|---|---|---|---|
| JP | S56-152269 | U | 11/1981 |
| JP | H07-159010 | A | 6/1995 |
| JP | H08-334272 | A | 12/1996 |
| JP | 2006-290042 | A | 10/2006 |
| JP | 2010-019439 | A | 1/2010 |
| JP | 4687710 | B2 | 2/2011 |
| JP | 2012-207823 | A | 10/2012 |
| WO | 03-019089 | A1 | 3/2003 |
| WO | 2007/074094 | A1 | 7/2007 |

OTHER PUBLICATIONS

International Search Report of the International Searching Authority dated Dec. 9, 2014 for the corresponding International application No. PCT/JP2014/076048 (and English translation).

Office action dated May 18, 2018 issued in corresponding Korean patent application No. 10-2017-7010861 (and English translation thereof).

* cited by examiner

REFRIGERATION CYCLE APPARATUS

CROSS REFERENCE TO RELATED APPLICATION

This application is a U.S. national stage application of PCT/JP2014/076048 filed on Sep. 30, 2014, the contents of which are incorporated herein by reference.

TECHNICAL FIELD

The present invention relates to a refrigeration cycle apparatus that is used for applications such as freezing or refrigeration, for example.

BACKGROUND

Conventional refrigeration cycle apparatuses include: an outdoor unit that has a compressor and a heat source-side heat exchanger; an indoor unit that has a use-side heat exchanger and a throttling apparatus; and refrigerant piping that connects these, and are configured such that the compressor, the heat source-side heat exchanger, the throttling apparatus, and the use-side heat exchanger are connected by piping (see Patent Literature 1, for example).

In recent years, from a viewpoint of environmental protection, hydrofluorocarbon (HFC) refrigerants (fluorocarbons that do not contain chlorine), which have an ozone depletion coefficient of zero, R-404A refrigerants (blended refrigerants of R-125, R-134a, and R-143a), R-410A refrigerants (50% by weight R-32 and 50% by weight R-125), etc., have been used as refrigerants that are sealed inside refrigeration cycle apparatuses. If a user upgrades from a refrigeration cycle apparatuses that uses an R-404A refrigerant to a refrigeration cycle apparatuses that uses an R-410A refrigerant, for example, then it is conceivable that crossover piping of the refrigeration cycle apparatus that has been used until then could be reused as the crossover piping for the new refrigeration cycle apparatus from a viewpoint of simplicity of construction work and reductions in parts costs.

However, the working pressure of R-410A is higher than the working pressure of R-404A. Thus, if crossover piping from a refrigeration cycle apparatus that uses an R-404A refrigerant is reused as crossover piping for a refrigeration cycle apparatus that uses an R-410A refrigerant, then the pressure of the refrigerant may rise if the temperature of the refrigerant rises due to an increase in outside air temperature particularly under conditions in which the refrigeration cycle apparatus is stopped due to a power outage, etc., in a state in which refrigerant has accumulated inside the crossover piping, and there has been a risk that the pressure of the refrigerant may exceed a pressure tolerance reference value of the crossover piping. Because of that, it has been necessary to change the crossover piping to thicker piping. In addition, when refrigeration cycle apparatuses are used in freezing and refrigeration of display cases that are installed in shops such as convenience stores or supermarkets, outdoor units are often installed in locations that are distant from indoor units, and the entire length of the crossover piping may reach 100 m. Thus, because installation of crossover piping at the site becomes complicated and material cost of the piping is high, some problems have been that installation time is longer, and that installation costs are also increased.

In consideration of such conditions, conventional refrigeration cycle apparatuses have been proposed that include:

liquid-side crossover piping and gas-side crossover piping that connect an outdoor unit and an indoor unit; liquid-side refrigerant piping that connects a condenser and the liquid-side crossover piping; gas-side refrigerant piping that connects a compressor and the gas-side crossover piping; first connection piping that extends from the liquid-side refrigerant piping or the liquid-side crossover piping; second connection piping that extends from the gas-side refrigerant piping or the gas-side crossover piping; a refrigerant storage tank that stores the refrigerant inside the crossover piping, an intake side thereof being connected to the first connection piping, and a discharge side thereof being connected to the second connection piping; a first check valve that is disposed on the first connection piping, and that allows the refrigerant to flow only in a direction of suction toward the refrigerant storage tank; a first electromagnetic valve that is disposed on the first connection piping, and that shuts off during passage of electric current; and a second electromagnetic valve that is disposed on the second connection piping, and that opens during passage of electric current (see Patent Literature 2, for example).

In the conventional refrigeration cycle apparatus that is described in Patent Literature 2, even if operation is shut down due to a power outage, etc., in a state in which refrigerant is accumulated inside the liquid-side crossover piping, the refrigerant inside the liquid-side crossover piping can be stored in the refrigerant storage tank temporarily, enabling the liquid refrigerant inside the liquid-side crossover piping to be removed. Thus, even if the refrigerant is a high-pressure refrigerant, and the external air becomes hot, problems with pressure tolerance in the liquid-side crossover piping do not arise. Because piping that has a pressure tolerance reference value for low-pressure refrigerant can thereby be used for the liquid-side crossover piping even if the refrigerant is changed from a low-pressure refrigerant to a high-pressure refrigerant, installation time can be shortened, and installation costs can be reduced.

[Patent Literature 1]

International Publication No. WO/2004/013549

[Patent Literature 2]

Japanese Patent No. 4687710 (Gazette)

However, in the conventional refrigeration cycle apparatus that is described in Patent Literature 2, because there is no mechanism for removing the gaseous refrigerant from inside the refrigerant storage tank when the refrigerant inside the liquid-side crossover piping is stored in the refrigerant storage tank, the refrigerant inside the liquid-side crossover piping could not be collected satisfactorily. Thus, the refrigerant may remain inside the liquid-side crossover piping, and there is a possibility that the pressure inside the liquid-side crossover piping may exceed the pressure tolerance reference value.

Furthermore, if an attempt is made to collect the refrigerant inside the liquid-side crossover piping without removing the gaseous refrigerant from inside the refrigerant storage tank, one problem has been that a large-capacity vessel is required as the vessel for the refrigerant storage tank, increasing vessel costs, and also increasing installation area.

SUMMARY

The present invention aims to solve the above problems and an object of the present invention is to provide a refrigeration cycle apparatus that can collect refrigerant inside liquid-side crossover piping during a stoppage even if liquid-side crossover piping for low-pressure refrigerant is used, enabling the occurrence of problems with pressure tolerance in the liquid-side crossover piping to be suppressed, shortening installation time, and enabling installation costs to be reduced, and that can also make a refrigerant storage tank more compact.

A refrigeration cycle apparatus according to the present invention includes: a heating unit that includes: a compressor that compresses and discharges refrigerant; and a condenser that condenses refrigerant that has been discharged from the compressor; a refrigerating unit that includes: a decompressing apparatus that decompresses refrigerant that flows out from the condenser; and an evaporator that evaporates refrigerant that flows out from the decompressing apparatus; liquid-side crossover piping and gas-side crossover piping that connect the heating unit and the refrigerating unit; liquid-side refrigerant piping that connects the condenser and the liquid-side crossover piping; and gas-side refrigerant piping that connects the compressor and the gas-side crossover piping, the refrigerant being sealed inside a main refrigerant circuit that passes from the compressor through the condenser, the liquid-side refrigerant piping, the liquid-side crossover piping, the decompressing apparatus, the evaporator, the gas-side crossover piping, and the gas-side refrigerant piping, and returns to the compressor. The present refrigeration cycle apparatus further includes: liquid-side connection piping that extends from the liquid-side refrigerant piping or the liquid-side crossover piping; gas-side connection piping that extends from the gas-side refrigerant piping or the gas-side crossover piping; a refrigerant storage tank that stores the refrigerant, an intake side thereof being connected to the liquid-side connection piping, and a discharge side thereof being connected to the gas-side connection piping; an inlet-side electromagnetic valve that is disposed on the liquid-side connection piping, and that is opened when there is no passage of electric current; an inlet-side check valve that is disposed on the liquid-side connection piping, and that allows the refrigerant to flow only toward the refrigerant storage tank; and a valve apparatus that is disposed on the gas-side connection piping, that is opened during passage of electric current to the inlet-side electromagnetic valve, and that is delayed before being shut off after passage of electric current to the inlet-side electromagnetic valve is stopped.

According to the present invention, because the inlet-side electromagnetic valve is shut off and the valve apparatus is open during operation, low pressure is maintained inside the refrigerant storage tank. Because the inlet-side electromagnetic valve is opened during a stoppage, high-pressure liquid refrigerant inside the liquid-side refrigerant piping and the liquid-side crossover piping flows into the refrigerant storage tank. Because the valve apparatus is open for a while after stopping, gaseous refrigerant inside the refrigerant storage tank is discharged while high-pressure liquid refrigerant flows into the refrigerant storage tank. Thus, the gaseous refrigerant that remains inside the refrigerant storage tank is prevented from being trapped inside the refrigerant storage tank, reaching high pressure inside the refrigerant storage tank, and preventing recovery of the high-pressure liquid refrigerant. Next, the valve apparatus is shut off such that the high-pressure liquid refrigerant is sealed inside the refrigerant storage tank. The high-pressure liquid refrigerant that remains inside the high-pressure-side refrigerant circuit is thereby recovered and sealed inside the refrigerant storage tank. Thus, because the occurrence of problems with pressure tolerance in the liquid-side crossover piping during a stoppage can be suppressed even if liquid-side crossover piping for low-pressure refrigerant is used, installation time can be shortened, and installation costs can be reduced. In addition, it is not necessary to increase the capacity of the refrigerant storage tank, also enabling the refrigerant storage tank to be made more compact.

DETAILED DESCRIPTION

Embodiment 1

Figure 1:
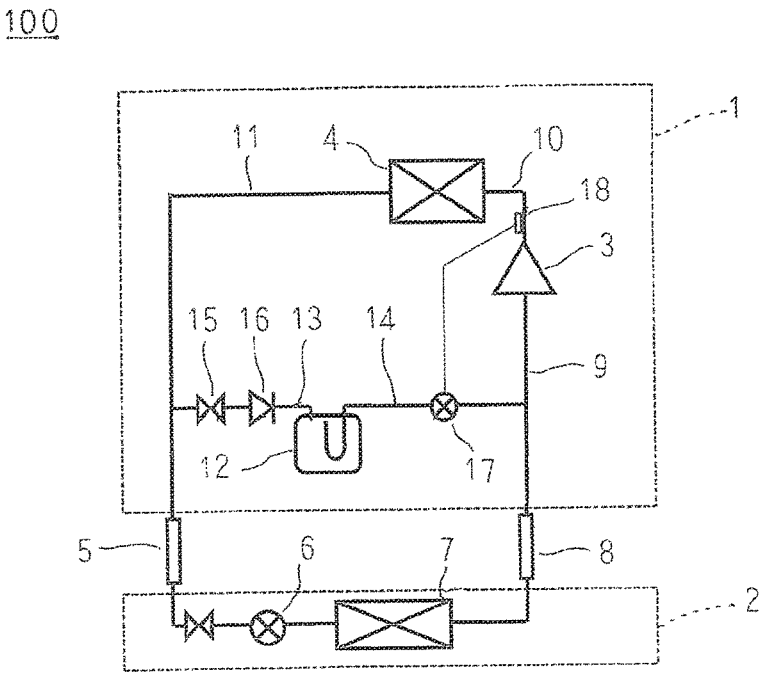
FIG. 1 is a refrigerant circuit configuration diagram for a refrigerating apparatus according to Embodiment 1 of the present invention.

FIG. 1 is a refrigerant circuit configuration diagram for a refrigeration cycle apparatus according to Embodiment 1 of the present invention.

In FIG. 1, a refrigeration cycle apparatus 100 includes: a heating unit 1 that is installed outside; a cooling unit 2 that is installed in a cooling subject, i.e., a store such as a convenience store or a supermarket, for example; and a refrigerant storage tank 12 that stores a refrigerant. The heating unit 1 and the cooling unit 2 are connected by means of liquid-side crossover piping 5 and gas-side crossover piping 8.

The heating unit 1 includes: a compressor 3 that compresses the refrigerant; and a condenser 4 that constitutes a heat source-side heat exchanger. An intake side of the compressor 3 is connected to the gas-side crossover piping 8 by means of gas-side refrigerant piping 9. A discharge side of the compressor 3 is connected to an inlet of the condenser 4 by means of discharge piping 10. An outlet of the condenser 4 is connected to the gas-side crossover piping 5 by means of liquid-side refrigerant piping 11.

The cooling unit 2 includes: a decompressing apparatus 6; and an evaporator 7 that constitutes a use-side heat exchanger. The cooling unit 2 includes a refrigerant circuit in which a high-pressure liquid refrigerant that flows in through the liquid-side crossover piping 5 flows sequentially through the decompressing apparatus 6, the evaporator 7, and the gas-side crossover piping 8. Here, the decompressing apparatus 6 expands and decompresses the high-pressure liquid refrigerant that flows in through the liquid-side crossover piping 5 using an electrically driven expansion valve that can adjust the flow rate of the refrigerant. The driving of the decompressing apparatus 6 is controlled by a controlling portion (not shown).

An intake side of the refrigerant storage tank 12 is connected to liquid-side connection piping 13 that extends from the liquid-side refrigerant piping 11, and a discharge side is connected to gas-side connection piping 14 that extends from the gas-side refrigerant piping 9. The gas-side connection piping 14 is mounted to the refrigerant storage tank 12 such that an end portion thereof (an outflow orifice) is positioned in an upper portion space inside the refrigerant storage tank 12. Specifically, the gas-side connection piping 14 is connected to the refrigerant storage tank 12 so as to have an opening in an upper portion inside the refrigerant storage tank 12, and enables only gaseous refrigerant inside the refrigerant storage tank 12 to flow out to the gas-side refrigerant piping 9. An inlet-side electromagnetic valve 15 that closes on passage of electric current and an inlet-side check valve 16 that enables flow only in a direction of inflow into the refrigerant storage tank 12 are disposed on the liquid-side connection piping 13. A mechanical on-off valve 17 that functions as a valve apparatus that opens and closes a valve mechanically is disposed on the gas-side connection piping 14.

Here, a thermal expansion valve that is used as a decompressing apparatus for general freezer and air conditioning equipment is used as the mechanical on-off valve 17. The thermal expansion valve is a type in which a refrigerant that is identical to the refrigerant that is used in the refrigeration cycle apparatus 100 is enclosed in a temperature sensitive cylinder 18, and the degree of opening of the expansion valve is regulated by saturation pressure that corresponds to the temperature of the temperature sensitive cylinder 18. The reference pressure that regulates the degree of opening of the expansion valve is the refrigerant saturation pressure at a portion near the expansion valve main body. The expansion valve is opened when the saturation pressure that corresponds to the temperature of the temperature sensitive cylinder 18 is higher than the reference pressure. Conversely, the expansion valve is closed when the saturation pressure that corresponds to the temperature of the temperature sensitive cylinder 18 is lower than or equal to the reference pressure. In Embodiment 1, the temperature sensitive cylinder 18 is disposed in the discharge piping 10, and opens and closes the expansion valve using the saturation pressure that corresponds to the temperature in the discharge piping 10. Because the temperature sensitive cylinder 18 is installed in the discharge piping 10, which is at a higher temperature, a large driving force for opening and closing the valve is obtained. Moreover, the installation site for the temperature sensitive cylinder 18 is not limited to the discharge piping 10, and should be a site at which a temperature that is higher than the saturation temperature that corresponds to the reference pressure is obtained during normal operation.

The liquid-side crossover piping 5 is upstream from the decompressing apparatus 6, and constitutes a high-pressure side of the refrigeration cycle. The gas-side crossover piping 8, on the other hand, is downstream from the decompressing apparatus 6, and constitutes a low-pressure side of the refrigeration cycle. In this refrigeration cycle apparatus 100, $CO_2$, which is a high-pressure refrigerant, is sealed inside, and pressure on the high-pressure side of the refrigeration cycle is less than or equal to critical pressure of the refrigerant. In other words, the high-pressure side of this refrigeration cycle apparatus 100 runs and operates at a pressure that is less than or equal to the set pressure of the liquid-side crossover piping 5. Here, the set pressure of the liquid-side crossover piping 5 is 4.15 MPa.

Moreover, an electromagnetic valve that opens on passage of electric current is one in which the valve opens only during electrification of the electromagnetic valve, and the valve is shut off by stopping the passage of electric current. An electromagnetic valve that closes on passage of electric current is one in which the valve shuts off only during electrification of the electromagnetic valve, and the valve is opened by stopping the passage of electric current.

Next, action during normal operation of the refrigeration cycle apparatus 100 will be explained.

When electric power is supplied to the refrigeration cycle apparatus 100, the decompressing apparatus 6 is opened, and the inlet-side electromagnetic valve 15 is shut off. Because the temperature of the discharge piping 10 is low and the saturation pressure that corresponds to the temperature of the temperature sensitive cylinder 18 is lower than the reference pressure, the mechanical on-off valve 17 is also shut off.

The gaseous refrigerant inside the gas-side refrigerant piping 9 is compressed by the compressor 3, flows through the discharge piping 10, and is conveyed to the condenser 4. The condenser 4 cools and condenses the refrigerant by releasing heat from the compressed gaseous refrigerant to a coolant such as air, water, or another refrigeration cycle, etc. The gaseous refrigerant is condensed by the condenser 4 and becomes a high-pressure liquid refrigerant, flows through the liquid-side refrigerant piping 11 and the liquid-side crossover piping 5, and is conveyed to the cooling unit 2.

The high-pressure liquid refrigerant that has been conveyed to the cooling unit 2 is expanded and decompressed by the decompressing apparatus 6. The evaporator 7 is disposed in a cooling vessel (such as a cooling display case, for example) that is installed in the store. The decompressed refrigerant is conveyed to the evaporator 7, evaporates while cooling the air inside the cooling vessel, and becomes low-pressure gaseous refrigerant. This low-pressure gaseous refrigerant flows through the gas-side crossover piping 8 and is conveyed to the heating unit 1, and flows through the gas-side refrigerant piping 9 and is conveyed to the compressor 3.

A main refrigerant circuit is thereby formed in which the refrigerant that is discharged from the compressor 3 is conveyed under pressure sequentially through the discharge piping 10, the condenser 4, the liquid-side refrigerant piping 11, the liquid-side crossover piping 5, the decompressing apparatus 6, the evaporator 7, the gas-side crossover piping 8, and the gas-side refrigerant piping 9, and flows back to the compressor 3.

The mechanical on-off valve 17 is opened when the temperature of the discharge piping 10 is high and the saturation pressure that corresponds to the temperature of the temperature sensitive cylinder 18 is higher than the reference pressure. Thus, the gaseous refrigerant inside the refrigerant storage tank 12 is sucked into the compressor 3 via the gas-side connection piping 14 and the gas-side refrigerant piping 9. The inside of the refrigerant storage tank 12 is thereby kept at low pressure that is equal to pressure on the intake side of the compressor 3.

Next, action when the refrigeration cycle apparatus 100 is stopped abnormally from normal operation due to a power outage, etc., will be explained.

When the supply of electric power to the refrigeration cycle apparatus 100 is stopped, the compressor 3 and the condenser 4 stop, the decompressing apparatus 6 is shut off, and the inlet-side electromagnetic valve 15 is opened. High-pressure liquid refrigerant accumulates inside the discharge piping 10, the condenser 4, the liquid-side refrigerant piping 11, and the liquid-side crossover piping 5, and low-pressure gaseous refrigerant accumulates inside the decompressing apparatus 6, the evaporator 7, the gas-side crossover piping 8, and the gas-side refrigerant piping 9, and flows back to the compressor 3. At this point, the temperature of the discharge piping 10 is high and the saturation pressure that corresponds to the temperature of the temperature sensitive cylinder 18 is higher than the reference pressure, and the mechanical on-off valve 17 is kept in an open state. The pressure inside the liquid-side refrigerant piping 11 is higher than the pressure in the refrigerant storage tank 12. Thus, the liquid refrigerant inside the discharge piping 10, the condenser 4, the liquid-side refrigerant piping 11, and the liquid-side crossover piping 5 flows through the liquid-side connection piping 13 and is recovered inside the refrigerant storage tank 12 due to the pressure difference between the liquid-side refrigerant piping 11 and the refrigerant storage tank 12. At this point, the gaseous refrigerant that has remained inside the refrigerant storage tank 12 is pushed out through the outflow orifice of the gas-side connection piping 14 that is positioned in the upper portion space inside the refrigerant storage tank 12 due to the inflow of the liquid refrigerant, and flows out through the gas-side connection piping 14 to the gas-side refrigerant piping 9.

Then, when the liquid refrigerant inside the discharge piping 10, the condenser 4, the liquid-side refrigerant piping 11, and the liquid-side crossover piping 5 is recovered inside the refrigerant storage tank 12, pressure inside the main refrigerant circuit of the refrigeration cycle apparatus 100 is equalized, and the temperature in the discharge piping 10 drops. The saturation pressure that corresponds to the temperature of the temperature sensitive cylinder 18 thereby becomes lower than the reference pressure, and the mechanical on-off valve 17 is shut off. Outflow of the refrigerant from the refrigerant storage tank 12 to the liquid-side refrigerant piping 11 is also prevented by the inlet-side check valve 16. The liquid refrigerant inside the discharge piping 10, the condenser 4, the liquid-side refrigerant piping 11, and the liquid-side crossover piping 5 is thereby recovered and sealed inside the refrigerant storage tank 12.

Now, when upgrading from a refrigeration cycle apparatus that uses an R-410A refrigerant to a refrigeration cycle apparatus that uses a carbon dioxide ($CO_2$) refrigerant, for example, which has a higher working pressure, it is conceivable that existing piping such as the liquid-side crossover piping 5 and the gas-side crossover piping 8 could be reused in order to reduce installation costs. Here, the refrigerant storage tank 12 is produced to a design pressure that corresponds to the $CO_2$ refrigerant (12 MPa, for example). Because it is dangerous if the refrigerant storage tank 12 becomes full of liquid and is liquid-tight, it is also necessary to set the capacity of the refrigerant storage tank 12 to greater than or equal to the liquid volume of all of the refrigerant that is sealed inside the refrigeration cycle apparatus 100.

The design pressure of the parts that handle the R-410A refrigerant is a saturation pressure of 4.15 MPa at 65 degrees Celsius, and corresponds to the saturation pressure of the $CO_2$ refrigerant at 8 degrees Celsius. In other words, there is a possibility that the design pressure (the reference pressure) of the parts that handled the R-410A refrigerant may be exceeded if the ambient temperature of the refrigeration cycle apparatus 100 exceeds 8 degrees Celsius. Because the refrigerant temperature of the $CO_2$ refrigerant, in particular, is supercritical at greater than or equal to 31 degrees Celsius, and the pressure is determined not by a gas-liquid two-phase state, but by a single-phase refrigerant density (the amount of refrigerant and the refrigerant circuit internal capacity), the pressure may rise excessively.

Thus, if there was an abnormal stoppage without the refrigerant storage tank 12, then the high-pressure liquid refrigerant that remains inside the high-pressure-side refrigerant circuit that is constituted by the discharge piping 10, the condenser 4, the liquid-side refrigerant piping 11, and the liquid-side crossover piping 5 would flow into the low-pressure-side refrigerant circuit that is constituted by the evaporator 7, the gas-side crossover piping 8, and the gas-side refrigerant piping 9 in which the low-pressure gaseous refrigerant remains, to equalize pressure inside the main refrigerant circuit. At this point, liquid refrigerant would be present inside the main refrigerant circuit, and if the temperature of the external air increased, the refrigerant pressure would rise, and could exceed the pressure tolerance reference value of the existing piping.

In the present refrigeration cycle apparatus 100, because the refrigerant storage tank 12 is included, if there is an abnormal stoppage, the high-pressure liquid refrigerant that remains inside the high-pressure-side refrigerant circuit that is constituted by the discharge piping 10, the condenser 4, the liquid-side refrigerant piping 11, and the liquid-side crossover piping 5 is recovered and sealed inside the refrigerant storage tank 12. Thus, because liquid refrigerant is not present inside the main refrigerant circuit, situations such as the refrigerant pressure inside the existing piping exceeding the pressure tolerance reference value of the existing piping are prevented even if the temperature of the external air increases.

In this manner, according to Embodiment 1, when upgrading from a refrigeration cycle apparatus that uses an R-410A refrigerant to a refrigeration cycle apparatus that uses a carbon dioxide ($CO_2$) refrigerant, for example, which has a higher working pressure, existing piping such as the liquid-side crossover piping 5 and the gas-side crossover piping 8 can be reused. Thus, because it is not necessary to use thick-walled piping that conforms to the pressure tolerance reference value that corresponds to the $CO_2$ refrigerant, and it is not necessary to install the thick-walled piping, installation time can be shortened, and installation costs can also be reduced.

An inlet-side electromagnetic valve 15 that closes on passage of electric current is disposed on the liquid-side connection piping 13, a mechanical on-off valve 17 is disposed on the gas-side connection piping 14, and a temperature sensitive cylinder 18 is disposed on the discharge piping 10. Thus, in a state of normal operation, the inlet-side electromagnetic valve 15 is kept in a shut-off state, and the mechanical on-off valve 17 is kept in an open state, enabling low pressure to be maintained inside the refrigerant storage tank 12. In addition, because the inlet-side electromagnetic valve 15 is kept in an open state if there is an abnormal stoppage from normal operation, and the mechanical on-off valve 17 is kept in an open state for a while after the abnormal stoppage, the gaseous refrigerant that remains inside the refrigerant storage tank 12 flows out to the gas-side refrigerant piping 9 by means of the gas-side connection piping 14 while the high-pressure liquid refrigerant that remains inside the high-pressure-side refrigerant circuit that is constituted by the discharge piping 10, the condenser 4, the liquid-side refrigerant piping 11, and the liquid-side crossover piping 5 flows into the refrigerant storage tank 12. In other words, gas is purged from inside the refrigerant storage tank 12. The gaseous refrigerant that remains inside the refrigerant storage tank 12 is thereby prevented from being trapped inside the refrigerant storage tank 12, reaching high pressure inside the refrigerant storage tank 12, and preventing recovery of the high-pressure liquid refrigerant, which enables high-density liquid refrigerant to be recovered efficiently, and also enables the amount of refrigerant recovered to be increased. In addition, it is not necessary to increase the capacity of the refrigerant storage tank 12, enabling the refrigerant storage tank 12 to be made compact.

In addition, because an inlet-side check valve 16 is disposed on the liquid-side connection piping 13, flow of the refrigerant from the refrigerant storage tank 12 to the liquid-side refrigerant piping 11 is prevented, enabling the high-pressure liquid refrigerant that remains inside the high-pressure-side refrigerant circuit that is constituted by the discharge piping 10, the condenser 4, the liquid-side refrigerant piping 11, and the liquid-side crossover piping 5 to be recovered and sealed inside the refrigerant storage tank 12.

Here, the driving force of refrigerant recovery during a power outage is differential pressure between the high-pressure-side pressure of the main refrigerant circuit and the low-pressure pressure inside the refrigerant storage tank 12. By purging gas from inside the refrigerant storage tank 12, low pressure is maintained inside the refrigerant storage tank 12 even if refrigerant flows in. However, a pressure drop in the high-pressure-side pressure arises due to pressure loss due to the flow of the refrigerant during refrigerant recovery. The pressure loss is particularly large if the liquid-side crossover piping 5 is long, making refrigerant recovery difficult. Thus, the refrigerant storage tank 12 should be installed so as to be positioned vertically lower than the liquid-side crossover piping 5, the liquid-side refrigerant piping 11, and the liquid-side connection piping 13. It is particularly preferable to install the refrigerant storage tank 12 so as to be positioned vertically lower than liquid-side crossover piping 5, which has a long piping length. The driving force from the liquid head is thereby added to the driving force due to the differential pressure, enabling the amount of refrigerant recovered to be increased, and further enabling pressure suppressing effects to be obtained.

In the refrigeration cycle apparatus 100, if an R-410A refrigerant is used, the differential pressure is approximately 2.0 MPa. If the piping diameter is set to ø12.7 mm, the piping length at which pressure loss in the piping becomes equal to the differential pressure is 227 m. Consequently, the refrigerant can be reliably recovered if the entire length of the liquid-side crossover piping 5, which has the longest piping length is less than or equal to 227 m. Flow speed of the refrigerant during recovery can be designed using a flow resistance value at the inlet of the refrigerant storage tank 12, and the time that low pressure is continuously maintained inside the refrigerant storage tank 12 is one minute. Thus, a refrigerant flow speed that can recover the refrigerant in one minute should be designed.

If a refrigerant with which the differential pressure that is the driving force of refrigerant recovery is even greater, such as carbon dioxide ($CO_2$), or R-1123, for example, is used, the refrigerant can be reliably recovered even if the entire length of the liquid-side crossover piping 5 is even longer. Moreover, the entire length of the liquid-side crossover piping 5 here is the piping length for which it is possible to purge gas from inside the refrigerant storage tank 12 and maintain low pressure in the refrigerant storage tank 12.

Moreover, in Embodiment 1 above, a check valve is not disposed on the gas-side connection piping 14, but an outlet-side check valve that enables flow only toward the gas-side refrigerant piping 9 may be disposed on the gas-side connection piping 14. In that case, the pressure inside the refrigerant storage tank 12 can be made even lower during normal operation by performing an operation such that the rotational frequency of the compressor 3 is increased momentarily to reduce the pressure inside the gas-side refrigerant piping 9 below the service pressure, and then the rotational frequency of the compressor 3 is returned to the original rotational frequency, to return the pressure inside the gas-side refrigerant piping 9 to the service pressure. In other words, the pressure inside the refrigerant storage tank 12 can be lowered by lowering the pressure inside the gas-side refrigerant piping 9 below the service pressure. Then, when the rotational frequency of the compressor 3 is returned to the original rotational frequency, and the pressure inside the gas-side refrigerant piping 9 returns to the service pressure, movement of the gaseous refrigerant from the gas-side refrigerant piping 9 toward the refrigerant storage tank 12 is prevented by the outlet-side check valve, and the pressure inside the refrigerant storage tank 12 is kept in a lower pressure state. The pressure difference between the liquid-side refrigerant piping 11 and the refrigerant storage tank 12 is thereby increased, facilitating the refrigerant recovery effect due to the refrigerant storage tank 12.

In Embodiment 1 above, a mechanical on-off valve 17 is used as a valve apparatus, but the valve apparatus is not limited to the mechanical on-off valve 17, provided that it is a valve apparatus that can remain open for a while after passage of electric current to the inlet-side electromagnetic valve 15 is stopped, and a condensing electromagnetic valve that opens on passage of electric current can be used, for example. In that case, electric driving power for the condensing electromagnetic valve is stored during normal operation, and the condensing electromagnetic valve is kept in an open state by the stored electric driving power for a while after stopping, to implement gas purging inside the refrigerant storage tank 12. Then, when the stored electric driving power is consumed, the condensing electromagnetic valve is shut off, and the liquid refrigerant is recovered and sealed inside the refrigerant storage tank 12. Consequently, effects that are similar or identical to when the mechanical on-off valve 17 is used can be obtained even if the condensing electromagnetic valve that opens on passage of electric current is used.

In Embodiment 1 above, the refrigerant storage tank 12 is installed inside the heating unit 1, but the refrigerant storage tank 12 may be installed outside the heating unit by extending the liquid-side connection piping 13 from the liquid-side crossover piping 5, and extending the gas-side connection piping 14 from the gas-side crossover piping 8. In that case, because the heating unit has a configuration that is similar or identical to the outdoor unit of a conventional refrigeration cycle apparatus, standardization of the outdoor unit is enabled, enabling systems construction costs to be reduced.

Embodiment 2

Figure 2:
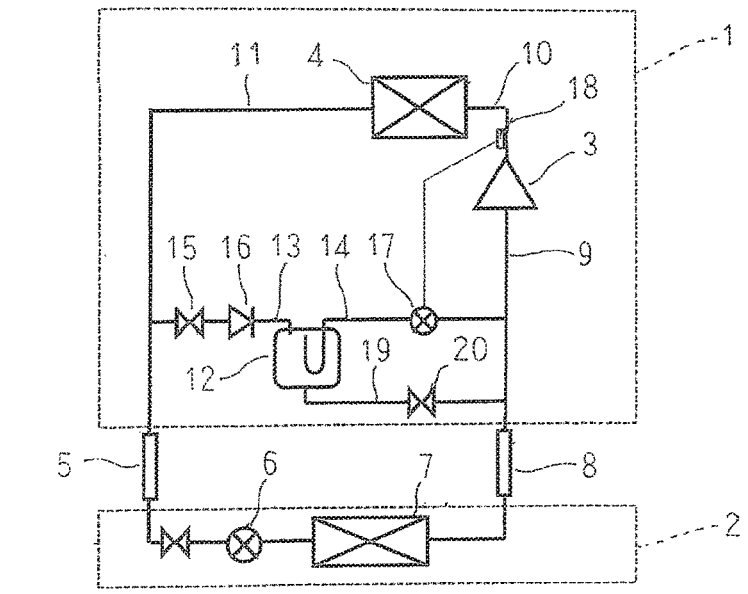
FIG. 2 is a refrigerant circuit configuration diagram for a refrigerating apparatus according to Embodiment 2 of the present invention.

FIG. 2 is a refrigerant circuit configuration diagram for a refrigeration cycle apparatus according to Embodiment 2 of the present invention.

In FIG. 2, refrigerant return piping 19 is disposed so as to link a lower portion inside a refrigerant storage tank 12 and gas-side refrigerant piping 9. An outlet-side electromagnetic valve 20 that opens on passage of electric current is disposed on the refrigerant return piping 19.

Moreover, a remainder of the configuration is formed in a similar or identical manner to that of Embodiment 1 above.

A refrigeration cycle apparatus 101 according to Embodiment 2 operates in a similar or identical manner to that of the refrigeration cycle apparatus 100 that is described above in that the outlet-side electromagnetic valve 20 is opened during normal operation. It also operates in a similar or identical manner to that of the refrigeration cycle apparatus 100 that is described above in that the outlet-side electromagnetic valve 20 is shut off when the refrigeration cycle apparatus 101 stops abnormally.

In this refrigeration cycle apparatus 101, when returning to normal operation from an abnormal stoppage state, the outlet-side electromagnetic valve 20 is opened, and the compressor 3 is operated. Thus, the gaseous refrigerant inside the gas-side refrigerant piping 9 is sucked into the compressor 3 and compressed, and is discharged to the discharge piping 10. Here, because the liquid refrigerant inside the refrigerant storage tank 12 flows through the refrigerant return piping 19 and is returned to the main refrigerant circuit, normal operation can be performed using a set amount of refrigerant.

Moreover, in Embodiment 2 above, the refrigerant return piping 19 is disposed so as to link the lower portion inside the refrigerant storage tank 12 and the gas-side refrigerant piping 9, but the refrigerant return piping 19 may be disposed so as to link the lower portion inside the refrigerant storage tank 12 and the gas-side crossover piping 8.

In Embodiment 2 above, the refrigerant return piping 19 is disposed so as to link the lower portion inside the refrigerant storage tank 12 and the gas-side refrigerant piping 9, but refrigerant return piping may be disposed so as to link the lower portion inside the refrigerant storage tank 12 and the gas-side connection piping 14 on a side of the mechanical on-off valve 17 near the refrigerant storage tank 12. In that case, outflow of the liquid refrigerant during refrigerant recovery can be prevented by making an aperture diameter of an end portion (an outflow orifice) of the refrigerant return piping that is positioned in a lower portion inside the refrigerant storage tank 12 smaller than the aperture diameter of an end portion (an outflow orifice) of the gas-side connection piping 14 that is positioned in the upper portion space inside the refrigerant storage tank 12 to make flow resistance in the outflow orifice of the refrigerant return piping greater than the flow channel resistance in the outflow orifice of the gas-side connection piping 14, for example.

Embodiment 3

Figure 3:
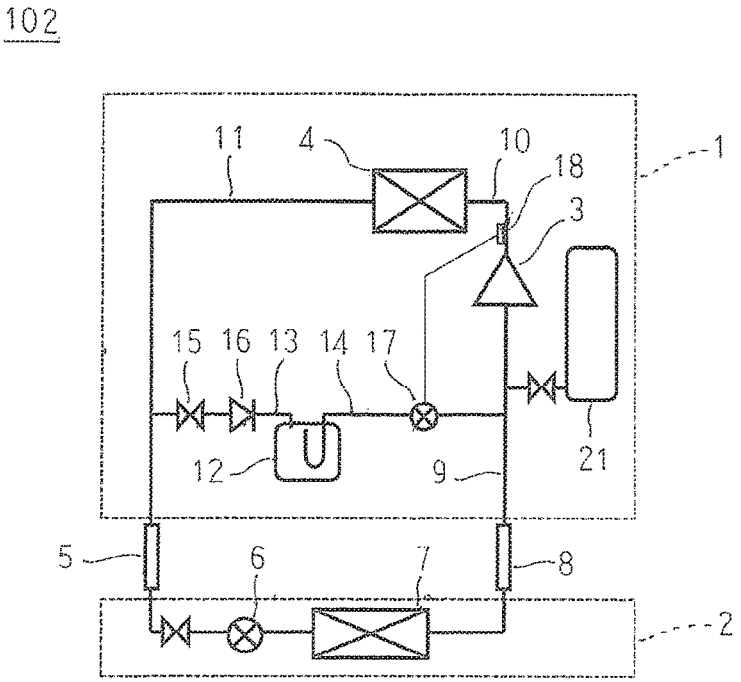
FIG. 3 is a refrigerant circuit configuration diagram for a refrigerating apparatus according to Embodiment 3 of the present invention.

FIG. 3 is a refrigerant circuit configuration diagram for a refrigeration cycle apparatus according to Embodiment 3 of the present invention.

In FIG. 3, an expansion tank 21 is connected to gas-side refrigerant piping 9, which is on an intake side of a compressor 3.

Moreover, a remainder of the configuration is formed in a similar or identical manner to that of Embodiment 1 above.

In the refrigeration cycle apparatus 102 according to Embodiment 3, because the expansion tank 21 is connected to the gas-side refrigerant piping 9, the internal capacity of the main refrigerant circuit can be increased, enabling pressure increases inside the main refrigerant circuit, etc., to be prevented. If the expansion tank 21 is installed on its own, an extremely large tank capacity is required, and there is a possibility that it may be lacking in practicality from the aspects of installation space and costs. In Embodiment 3, because the expansion tank 21 and the refrigerant storage tank 12 are used in combination, refrigerant in the main refrigerant circuit is significantly removed, enabling reductions in size of the expansion tank 21, thereby enabling the installation space and cost reducing effects to be obtained.

Moreover, in Embodiment 3 above, the expansion tank 21 is connected to the gas-side refrigerant piping 9, but the expansion tank 21 may be connected to the gas-side crossover piping 8.

Embodiment 4

Figure 4:
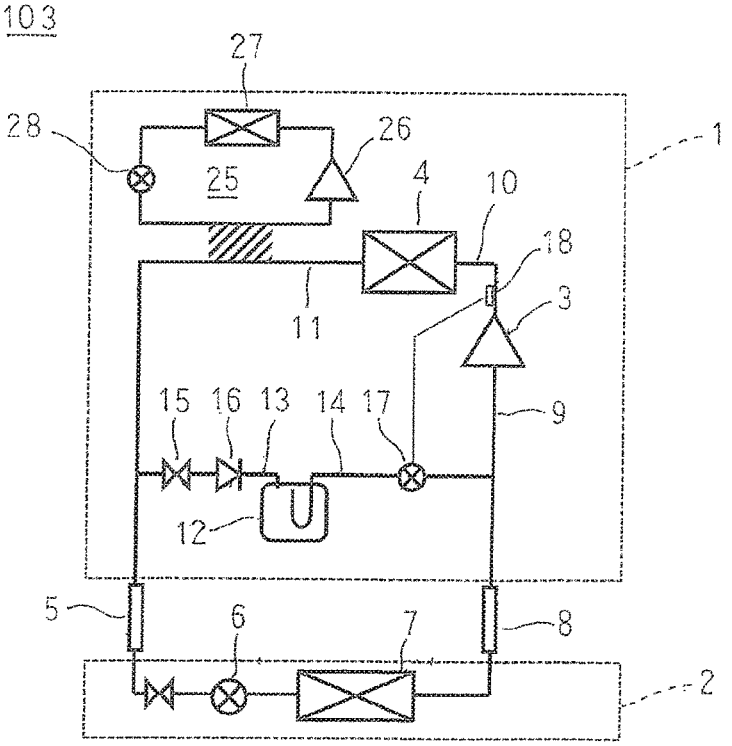
FIG. 4 is a refrigerant circuit configuration diagram for a refrigerating apparatus according to Embodiment 4 of the present invention.

FIG. 4 is a refrigerant circuit configuration diagram for a refrigeration cycle apparatus according to Embodiment 4 of the present invention.

In FIG. 4, a second refrigeration cycle 25 that functions as a pressure adjusting mechanism portion is configured into a refrigerant circuit in which a refrigerant flows sequentially through a compressor 26, a condenser 27, and an evaporator 28 and returns to the compressor 26, and is disposed so as to enable refrigerant that has been evaporated by the evaporator 28 to exchange heat with refrigerant that has been condensed by a condenser 4.

Moreover, a remainder of the configuration is formed in a similar or identical manner to that of Embodiment 1 above.

In a refrigeration cycle apparatus 103 according to Embodiment 4, because the high-pressure refrigerant that has been condensed by the condenser 4 exchanges heat with the refrigerant that has been evaporated by the evaporator 28 of the second refrigeration cycle 25, the refrigerant inside the high-pressure-side refrigerant circuit of the refrigeration cycle apparatus 103 is cooled, and is controlled so as not to become supercritical. Thus, because the pressure of the refrigerant inside the high-pressure-side refrigerant circuit of the refrigeration cycle apparatus 103 can be reduced to less than or equal to the critical pressure, the refrigerant inside the high-pressure-side refrigerant circuit can be recovered as high-density liquid refrigerant during a stoppage.

Embodiment 5

Figure 5:
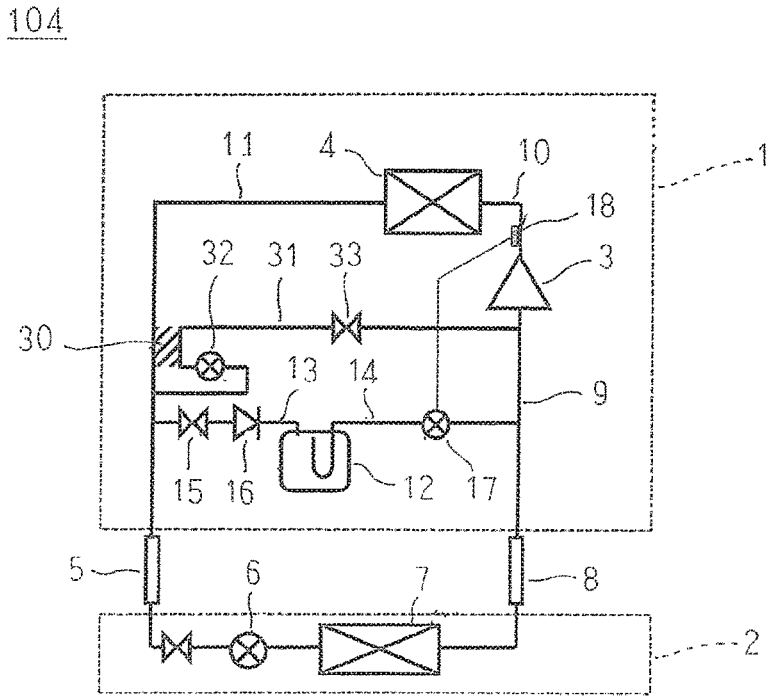
FIG. 5 is a refrigerant circuit configuration diagram for a refrigerating apparatus according to Embodiment 5 of the present invention.

FIG. 5 is a refrigerant circuit configuration diagram for a refrigeration cycle apparatus according to Embodiment 5 of the present invention.

In FIG. 5, a bypass heat exchanging portion 30 that functions as a pressure adjusting mechanism portion is formed on liquid-side refrigerant piping 11 nearer to a condenser 4 than a connecting portion of liquid-side connection piping 13. Bypass piping 31 branches off from the liquid-side refrigerant piping 11 between the bypass heat exchanging portion 30 and the connecting portion of the liquid-side connection piping 13 and is connected to gas-side refrigerant piping 9. The bypass heat exchanging portion 30 is configured such that heat is exchanged between refrigerant that has been condensed by the condenser 4 and that flows through the liquid-side refrigerant piping 11 and refrigerant that flows through the bypass piping 31. An expansion valve 32 that functions as a bypass decompressing apparatus is disposed in the bypass piping 31 upstream from the bypass heat exchanging portion 30. An electromagnetic valve 33 that opens on passage of electric current is also disposed in the bypass piping 31 downstream from the bypass heat exchanging portion 30.

Moreover, a remainder of the configuration is formed in a similar or identical manner to that of Embodiment 1 above.

In a refrigeration cycle apparatus 104 according to Embodiment 5, refrigerant that has been condensed by the condenser 4 and that flows through the liquid-side refrigerant piping 11 exchanges heat at the bypass heat exchanging portion 30 with the refrigerant that has been decompressed by the expansion valve 32, and is supercooled. Because the pressure of the refrigerant inside the high-pressure-side refrigerant circuit of the refrigeration cycle apparatus 103 can thereby be reduced to less than or equal to the critical pressure, the refrigerant distribution inside the high-pressure-side refrigerant circuit can be increased, enabling the amount of refrigerant recovered by the refrigerant storage tank 12 during shutdown of the refrigeration cycle apparatus 104 to be increased.

Moreover, in Embodiment 5 above, the bypass piping 31 is connected to the gas-side refrigerant piping 9, but the bypass piping 31 may be connected to intermediate pressure of the compressor 3.

Embodiment 6

Figure 6:
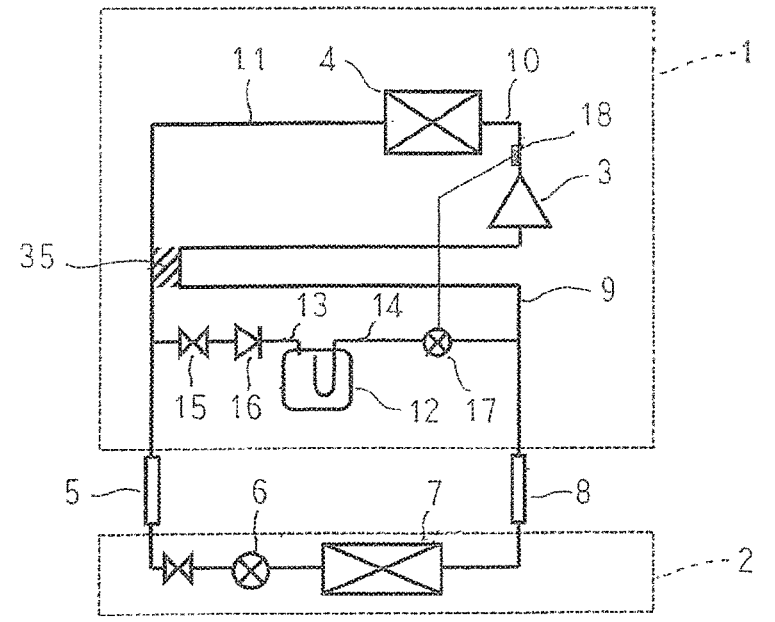
FIG. 6 is a refrigerant circuit configuration diagram for a refrigerating apparatus according to Embodiment 6 of the present invention.

FIG. 6 is a refrigerant circuit configuration diagram for a refrigeration cycle apparatus according to Embodiment 6 of the present invention.

In FIG. 6, an internal heat exchanging portion 35 that functions as a pressure adjusting mechanism portion is formed on liquid-side refrigerant piping 11 nearer to a condenser 4 than a connecting portion of liquid-side connection piping 13. The internal heat exchanging portion 35 is configured such that heat is exchanged between refrigerant that has been condensed by the condenser 4 and that flows through the liquid-side refrigerant piping 11 and refrigerant that flows through gas-side refrigerant piping 9.

Moreover, a remainder of the configuration is formed in a similar or identical manner to that of Embodiment 1 above.

In a refrigeration cycle apparatus 105 according to Embodiment 6, refrigerant that has been condensed by the condenser 4 and that flows through the liquid-side refrigerant piping 11 exchanges heat at the internal heat exchanging portion 35 with the gaseous refrigerant that has been decompressed by the decompressing apparatus 6, that has been evaporated by the evaporator 7, and that flows through the gas-side refrigerant piping 9, and is supercooled. Because the pressure of the refrigerant inside the high-pressure-side refrigerant circuit of the refrigeration cycle apparatus 105 can thereby be reduced to less than or equal to the critical pressure, the refrigerant distribution inside the high-pressure-side refrigerant circuit can be increased, enabling the amount of refrigerant recovered by the refrigerant storage tank 12 during shutdown of the refrigeration cycle apparatus 105 to be increased.

Embodiment 7

Figure 7:
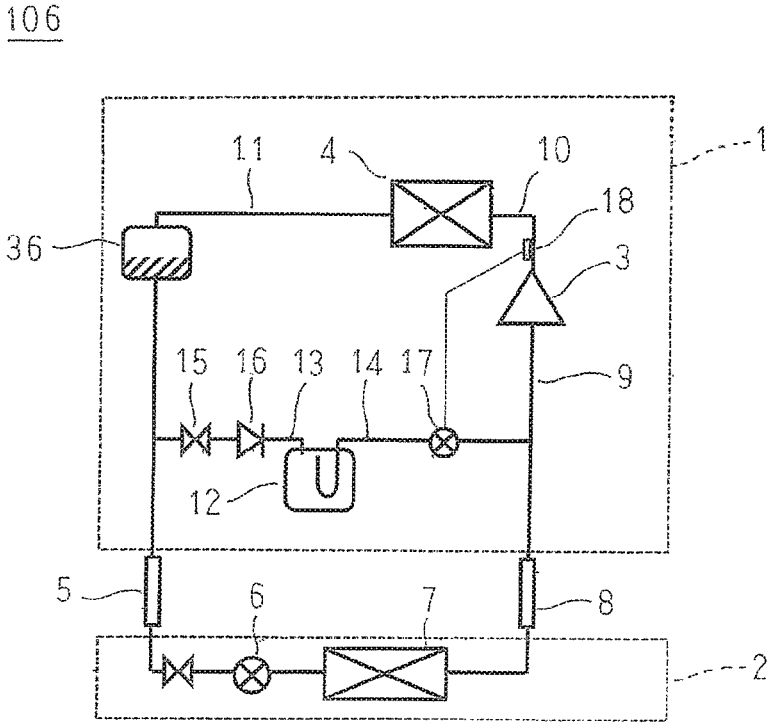
FIG. 7 is a refrigerant circuit configuration diagram for a refrigerating apparatus according to Embodiment 7 of the present invention.

FIG. 7 is a refrigerant circuit configuration diagram for a refrigeration cycle apparatus according to Embodiment 7 of the present invention.

In FIG. 7, a liquid receiver 36 is disposed on liquid-side refrigerant piping 11 nearer to a condenser 4 than a connecting portion of liquid-side connection piping 13.

Moreover, a remainder of the configuration is formed in a similar or identical manner to that of Embodiment 1 above.

In a refrigeration cycle apparatus 106 according to Embodiment 7, because the liquid receiver 36 is disposed on the liquid-side refrigerant piping 11, much liquid refrigerant is stored in a high-pressure refrigerant circuit. The refrigerant distribution inside the high-pressure-side refrigerant circuit can be increased thereby, enabling the amount of refrigerant recovered by the refrigerant storage tank 12 during shutdown of the refrigeration cycle apparatus 105 to be increased.

Moreover, in each of the above embodiments, when upgrading from a refrigeration cycle apparatus that uses an R-410A refrigerant to a refrigeration cycle apparatus that uses a carbon dioxide ($CO_2$) refrigerant, which has a higher working pressure, existing piping which has a pressure setting for a low-pressure refrigerant such as the liquid-side crossover piping 5 and the gas-side crossover piping 8 has been reused in order to reduce installation costs. The refrigerant that has a higher working pressure is not limited to a $CO_2$ refrigerant, and may be an R-1123 refrigerant, for example.

The R-1123 refrigerant is flammable, but because the refrigerant storage tank 12 is used in the present refrigeration cycle apparatus, most of the R-1123 refrigerant can be stored in the refrigerant storage tank 12 even during power outages. Leakage of the R-1123 refrigerant into rooms can thereby be prevented, enabling superior safety to be accomplished. Thus, these effects can be similarly achieved even if refrigerants such as hydrocarbon (HC) refrigerants (such as R-600a or R-290) or hydrofluoroolefin (HFO) refrigerants (such as R-1234yf or R-1234ze), which are flammable, or ammonia ($NH_3$), which is toxic, etc., are used as the refrigerant of the present refrigeration cycle apparatus.

Furthermore, a single refrigerant from refrigerant groups including $CO_2$, R-600a, R-290, R-1234yf, R-1234ze, and $NH_3$ may be sealed into the present refrigeration cycle apparatus, or a blended refrigerant in which a plurality of refrigerants that are selected from these refrigerant groups are mixed together may be sealed into the present refrigeration cycle apparatus.

The invention claimed is:

1. A refrigeration cycle apparatus comprising:

a heating unit that comprises:

a compressor that compresses and discharges refrigerant; and a condenser that condenses refrigerant that has been discharged from said compressor;

a refrigerating unit that includes:

a decompressing apparatus that decompresses refrigerant that flows out from said condenser; and an evaporator that evaporates refrigerant that flows out from said decompressing apparatus;

liquid-side crossover piping and gas-side crossover piping that connect said heating unit and said refrigerating unit;

liquid-side refrigerant piping that connects said condenser and said liquid-side crossover piping; and gas-side refrigerant piping that connects said compressor and said gas-side crossover piping, said refrigerant being sealed inside a main refrigerant circuit that passes from said compressor through said condenser, said liquid-side refrigerant piping, said liquid-side crossover piping, said decompressing apparatus, said evaporator, said gas-side crossover piping, and said gas-side refrigerant piping, and returns to said compressor, wherein said refrigeration cycle apparatus further comprises:

liquid-side connection piping that extends from said liquid-side refrigerant piping or said liquid-side crossover piping;

gas-side connection piping that extends from said gas-side refrigerant piping or said gas-side crossover piping;

a refrigerant storage tank that stores said refrigerant, an intake side thereof being connected to said liquid-side connection piping, and a discharge side thereof being connected to said gas-side connection piping;

an inlet-side electromagnetic valve that is disposed on said liquid-side connection piping, and that is opened when there is no passage of electric current;

an inlet-side check valve that is disposed on said liquid-side connection piping, and that allows said refrigerant to flow only toward said refrigerant storage tank; and a valve apparatus that is disposed on said gas-side connection piping, that is opened during passage of electric current to said inlet-side electromagnetic valve, and that is delayed before being shut off after passage of electric current to said inlet-side electromagnetic valve is stopped.

2. The refrigeration cycle apparatus according to claim 1, wherein said valve apparatus is an on-off valve that opens and closes mechanically.

3. The refrigeration cycle apparatus according to claim 2, wherein said on-off valve is opened and closed using a refrigerant saturation pressure that corresponds to a discharging portion temperature of said compressor as a driving force.

4. The refrigeration cycle apparatus according to claim 1, wherein said valve apparatus is a condensing electromagnetic valve that is opened and stores electric power during passage of electric current, and that maintains an open state using said stored electric power after said passage of electric current is stopped.

5. The refrigeration cycle apparatus according to claim 1, wherein said gas-side connection piping is connected to said refrigerant storage tank so as to have an opening in an upper portion inside said refrigerant storage tank.

6. The refrigeration cycle apparatus according to claim 5, further comprising refrigerant return piping that links:

a lower portion inside said refrigerant storage tank; and said gas-side connection piping nearer to said refrigerant storage tank than said valve apparatus, flow channel resistance of an opening portion of said refrigerant return piping inside said refrigerant storage tank being greater than flow channel resistance of an opening portion of said gas-side connection piping inside said refrigerant storage tank.

7. The refrigeration cycle apparatus according to claim 5, further comprising:

refrigerant return piping that links a lower portion inside said refrigerant storage tank and said gas-side refrigerant piping or said gas-side crossover piping; and an outlet-side electromagnetic valve that opens on passage of electric current, said outlet-side electromagnetic valve being disposed on said refrigerant return piping.

8. The refrigeration cycle apparatus according to claim 1, wherein said refrigerant storage tank is disposed vertically lower than said liquid-side crossover piping.

9. The refrigeration cycle apparatus according to claim 1, wherein an R410A refrigerant is sealed inside said main refrigerant circuit, a piping diameter of said liquid-side crossover piping is 12.7 mm, and a piping length of said liquid-side crossover piping is less than or equal to 227 m.

10. The refrigeration cycle apparatus according to claim 1, wherein capacity of said refrigerant storage tank is greater than or equal to a liquid volume of said refrigerant that is sealed inside said main refrigerant circuit.

11. The refrigeration cycle apparatus according to claim 1, further comprising an expansion tank that is connected to said gas-side refrigerant piping or said gas-side crossover piping.

12. The refrigeration cycle apparatus according to claim 1, further comprising a pressure adjusting mechanism portion that adjusts a pressure inside a high-pressure-side refrigerant circuit of said main refrigerant circuit from a discharge side of said compressor to said refrigerating unit to less than or equal to critical pressure.

13. The refrigeration cycle apparatus according to claim 12, wherein said pressure adjusting mechanism portion is a second refrigeration cycle apparatus that cools refrigerant that flows through said liquid-side refrigerant piping.

14. The refrigeration cycle apparatus according to claim 12, wherein said pressure adjusting mechanism portion is an internal heat exchanging portion that exchanges heat between refrigerant that flows through said liquid-side refrigerant piping and refrigerant that flows through said gas-side refrigerant piping.

15. The refrigeration cycle apparatus according to claim 12, further comprising:

bypass piping that branches off from said liquid-side refrigerant piping and is connected to said gas-side refrigerant piping; and a bypass decompressing apparatus that is disposed on said bypass piping, said pressure adjusting mechanism portion being a bypass heat exchanging portion that exchanges heat between refrigerant that flows through said liquid-side refrigerant piping and refrigerant that has been decompressed by said bypass decompressing apparatus and that flows through said bypass piping.

16. The refrigeration cycle apparatus according to claim 1, further comprising a liquid receiver that collects refrigerant that is conveyed to said decompressing apparatus.

17. The refrigeration cycle apparatus according to claim 1, wherein said refrigerant that is sealed inside said main refrigerant circuit is at least one refrigerant from a refrigerant group that includes carbon dioxide ($CO_2$), R-600a, R-290, R-1234yf, R-1234ze, R-1123, and ammonia ($NH_3$).

18. The refrigeration cycle apparatus according to claim 1, wherein said refrigerant that is sealed inside said main refrigerant circuit is a flammable or toxic refrigerant.

* * * * *